US008347572B2

(12) United States Patent
Piedmont

(10) Patent No.: US 8,347,572 B2
(45) Date of Patent: Jan. 8, 2013

(54) LIGHTWEIGHT BEAM STRUCTURE

(75) Inventor: Gregory Piedmont, Helendale, CA (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 13/090,185

(22) Filed: Apr. 19, 2011

(65) Prior Publication Data

US 2012/0266561 A1 Oct. 25, 2012

(51) Int. Cl.
*E04C 1/00* (2006.01)

(52) U.S. Cl. ..... 52/309.4; 52/309.1; 52/309.7

(58) Field of Classification Search ..... 52/309.1, 52/309.4, 309.7
See application file for complete search history.

(56) References Cited

U.S. PATENT DOCUMENTS

| | | | | |
|---|---|---|---|---|
| 3,339,326 | A | 9/1967 | Derr et al. | |
| 3,544,417 | A * | 12/1970 | Corzine | 428/104 |
| 4,706,985 | A | 11/1987 | Meatto | |
| 5,332,178 | A | 7/1994 | Williams | |
| 5,356,519 | A * | 10/1994 | Grabscheid et al. | 162/281 |
| 5,379,567 | A | 1/1995 | Vahey | |
| 6,151,743 | A * | 11/2000 | Church et al. | 14/73 |
| 6,197,112 | B1 * | 3/2001 | Stotz et al. | 118/100 |
| 6,591,567 | B2 | 7/2003 | Hota et al. | |
| 6,740,381 | B2 | 5/2004 | Day et al. | |
| 7,707,800 | B2 * | 5/2010 | Kannisto | 52/836 |
| 2002/0026765 | A1 | 3/2002 | Vahey | |
| 2004/0074180 | A1 * | 4/2004 | Barmakian et al. | 52/309.7 |
| 2005/0050836 | A1 * | 3/2005 | Barmakian | 52/720.1 |
| 2005/0074593 | A1 | 4/2005 | Day et al. | |
| 2007/0175165 | A1 | 8/2007 | Hillman | |
| 2007/0259135 | A1 | 11/2007 | Hascalovich et al. | |
| 2008/0041011 | A1 * | 2/2008 | Kannisto | 52/726.2 |
| 2008/0292854 | A1 | 11/2008 | Miller et al. | |
| 2009/0202776 | A1 | 8/2009 | Brandon et al. | |
| 2010/0266833 | A1 | 10/2010 | Day et al. | |

FOREIGN PATENT DOCUMENTS

| | | |
|---|---|---|
| DE | 1 205 685 | 11/1965 |
| GB | 2 441 753 | 3/2008 |

* cited by examiner

*Primary Examiner* — Mark Wendell
(74) *Attorney, Agent, or Firm* — McDermott Will & Emery LLP

(57) ABSTRACT

A lightweight beam may have a triangular prism core and a triaxial fabric cover wrapped around the core, with at least one rod proximate an apex of the core. The rod may extend substantially parallel to a centerline of the core. Multiple lightweight beams may be joined to form a larger lightweight structure.

20 Claims, 3 Drawing Sheets

LIGHTWEIGHT BEAM STRUCTURE

STATEMENT AS TO RIGHTS TO INVENTIONS MADE UNDER FEDERALLY SPONSORED RESEARCH OR DEVELOPMENT

Not Applicable.

FIELD

The present disclosure generally relates to structural members and, in particular, relates to a lightweight beam structure.

BACKGROUND

Lightweight beams are typically formed using pultrusion machines or filament winding around a mandrel. Such techniques place a strain on resources and may provide difficulty in removing a mandrel from the formed beam.

SUMMARY

The following presents a simplified summary of one or more aspects in order to provide a basic understanding of such aspects. This summary is not an extensive overview of all contemplated aspects, and is intended to neither identify key or critical elements of all aspects nor delineate the scope of any or all aspects. Its sole purpose is to present some concepts of one or more aspects in a simplified form as a prelude to the more detailed description that is presented later.

According to some aspects, the present disclosure provides a lightweight beam including a triangular prism core having a triaxial fabric cover and at least one rod proximate an apex of the core. The rod may extend substantially parallel to a centerline of the core. According to some aspects, multiple lightweight beams may be joined to form a structure. According to certain aspects, a lightweight beam may be formed by providing the core and at least one rod proximate at least one apex of the core, and wrapping the triaxial fabric cover about the core.

Additional features and advantages of the subject technology will be set forth in the description below, and in part will be apparent from the description, or may be learned by practice of the subject technology. The advantages of the subject technology will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide further understanding of the subject technology and are incorporated in and constitute a part of this specification, illustrate aspects of the subject technology and together with the description serve to explain the principles of the subject technology.

DETAILED DESCRIPTION

In the following detailed description, numerous specific details are set forth to provide a full understanding of the subject technology. It will be apparent, however, to one ordinarily skilled in the art that the subject technology may be practiced without some of these specific details. In other instances, well-known structures and techniques have not been shown in detail so as not to obscure the subject technology. Like components are labeled with identical element numbers for ease of understanding.

Figure 1:
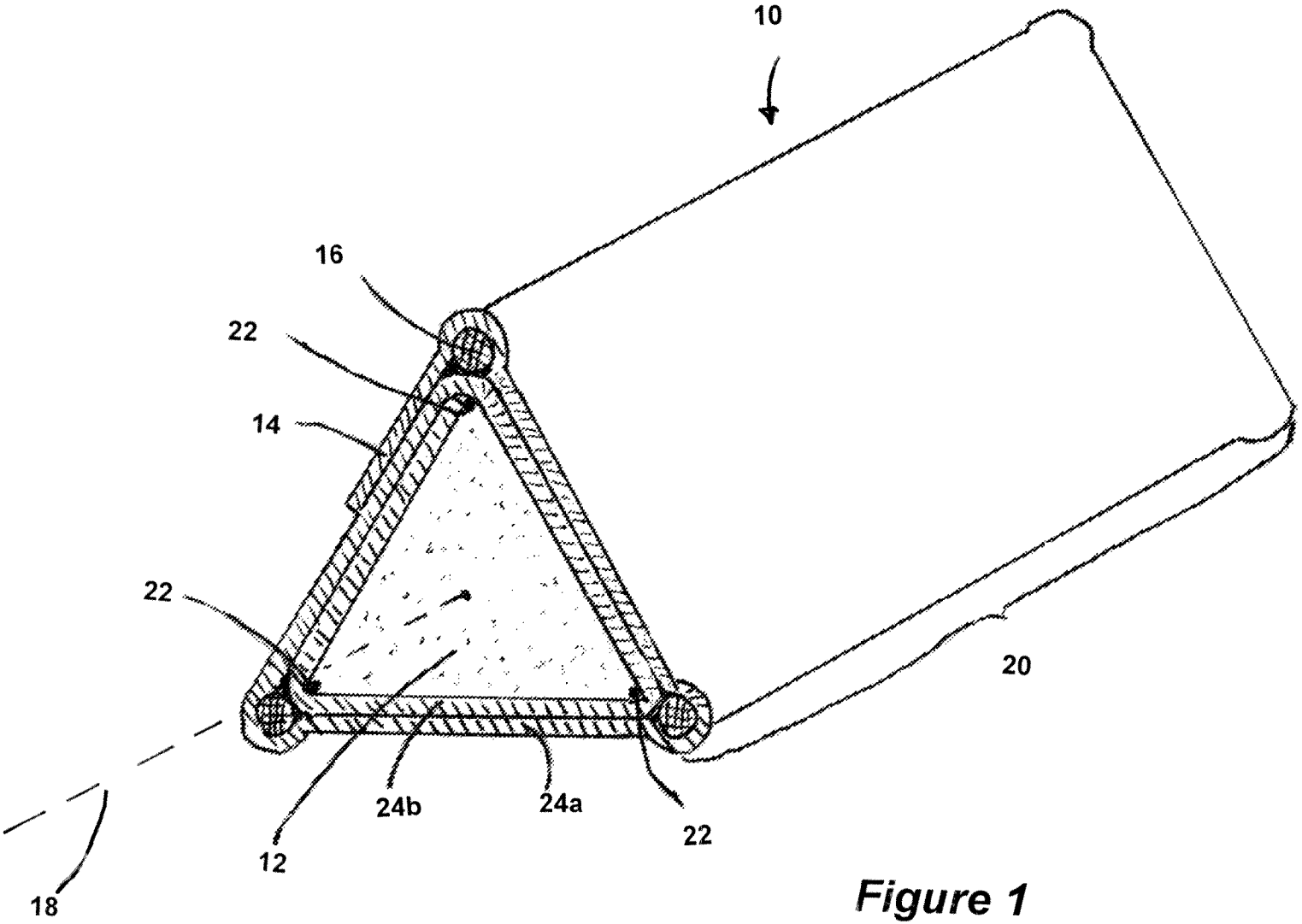
FIG. 1 is a perspective view of a lightweight beam, in accordance with one aspect of the present disclosure.

Now referring to FIG. 1, a lightweight beam 10 is illustrated in accordance with one aspect of the present disclosure. The lightweight beam 10 may be useful for a particular function, such as load bearing, shear resistance, and the like. The function of the lightweight beam 10 may be modular, allowing a particular function, such as strength, to be optimized, while minimizing the weight of the lightweight beam 10. In some aspects, the materials and methods used to form the lightweight beam 10 may allow for the lightweight beam to be hand laid-up in a simple out of autoclave process, which may reduce costs associated with filament winding and pultrusion machines associated with use of a mandrel in formation of lightweight beams.

The lightweight beam 10 may be formed from a core 12, a cover 14 disposed about the core 12, and at least one rod 16 extending substantially parallel to a central axis or longitudinal centerline 18 of the core 12. The core 12 may be an elongated member having a length 20. The core 12 may have a small diameter or other cross-sectional dimension. For example, the largest dimension of the core 12, other than the length 20, may be less than 0.5". The core 12 may have any of a number of cross-sectional shapes, including triangular, circular, rectangular, etc. In one aspect, the core 12 forms a triangular prism shape, such as, for example, an equilateral triangular prism (i.e., a triangular prism having an equilateral triangular cross-section), thus incorporating stability inherent in a triangular base. Each side of the triangular prism may be geometrically locked, unlike a square or cylindrical prism. Thus, the rigidity of each of the surfaces may be used to effectively counter shear forces. The core 12 may be made from a foam and/or other lightweight materials having compressive strength. The foam may be a solid lightweight material such as closed cell foam, open cell foam, or any other foam or foam-like material suitable for providing some compressive strength, and/or providing a simplified bonding surface around which the cover 14 or other carbon structure may be formed. In some aspects the core 12 is fabricated from the foam, for example, by extruding the foam longitudinally into a triangular prism or other shape. The surface of the core 12 may lock the cover 14 or other carbon surface to its exact form. In some aspects, the core 12 may be treated prior to the placement of the cover 14. For example, an adhesive or other substance (not shown) may be sprayed or otherwise applied to ensure good bonding of the cover 14 to the core 12. Because the cover 14 may be formed about the core 12, the drawbacks commonly associated with use of a mandrel as the base structural element about which the carbon structure is formed may be reduced. For example, mandrels may require removal from the carbon structure prior to use. The core 12, on the other hand, may remain in place as part of the lightweight beam 10.

Thus, the core 12 combined with the cover 14 may provide greatly increased strength over a similarly sized hollow beam, while remaining lightweight.

Referring still to FIG. 1, the cover 14 may be a spool, sheet, tape, or other material form that is wrapped, molded, or otherwise formed around the core 12, using the core 12 as a template or base. The cover 14 may be made of lightweight materials, such as fabric, or any other material suitable for providing shear strength. When the cover 14 includes fabric, the fabric may be a triaxial fabric. Triaxial fabric may offer advantages over traditional fabrics, including increased shear strength. One triaxial fabric, QISO™, available from A&P Technology of Cincinnati, Ohio, is a single layer quasi-isotropic carbon fabric having a triaxial braided fiber architecture of 0°, +/−60° and a drapable consistent fiber orientation. This triaxial fabric includes bias yarns that are two over two under alternating over and under the axial yarns with equal amounts of material by weight in each direction. This triaxial fabric may provide all layers with the same architecture, allowing multiple layers of triaxial fabric to have reduced interlaminar stresses. The +60° bias combined with the −60° bias over and under the axial 0°, may allow this triaxial fabric to have twice the amount of carbon fiber per ply, to be directed in the intended direction, as compared with the typical 0/90° weave. The 0/90° bias only allows the 90° fibers to be of use in a shear strength application. When turned to a +/−45° orientation, the fiber angle offers less shear strength than the +/−60° orientation and lacks the additional 0° axial fiber for cohesion. Thus, the cover 14 (e.g., in the form of triaxial fabric), may be laid up with a +/−60° bias running lengthwise (i.e., parallel with the centerline 18) down the core 12. A small number of layers (e.g., as few as one, two, or three) of triaxial fabric may provide a suitable degree of shear strength. Once the cover 14 is disposed about the core 12, it may be treated. For example, the core may be cured, sealed, or otherwise "set."

The rod 16 may be a reinforcement member extending substantially parallel to the centerline 18 of the core 12. The rod 16 may be placed proximate at least one of the three apexes 22 of a triangular prism core 12. In some aspects, additional rods may be placed proximate additional apexes. For example, three rods 16 may be placed proximate three apexes 22, as illustrated. Alternatively, the rod 16 may be placed at other locations in, on, or near the core 12. The rod 16 may be inserted into the core 12 and cover 14 after the cover 14 is disposed about the core 12. Alternatively, the rod 16 may be placed on an outer surface of the core 12 before the cover 14 is placed about the core 12. In yet another aspect, the rod 16 may be placed within the cover 14, either before, after, or during placement about the core 12. For example, the rod 16 may lie between layers 24 (e.g., 24*a* and 24*b*) of fabric or other material used to form or otherwise construct the cover 14. The rod 16 may have a circular cross-section with a small diameter (e.g., as small as 0.20"). The rod 16 may extend along some or all of the length 20 of the core 12. In one aspect, the rod 16 extends substantially the length 20 of the core 12, such that the cross-sectional view of the lightweight beam 10 is substantially constant along a length of the lightweight beam 10. The rod 16 may be fabricated of carbon configured to provide consolidated unidirectional fiber that may be directed at the optimum 90° angle. The fibers of the rod 16 may be compacted into a bundle, so as to offer greater shear strength than a comparable think layer of unidirectional fibers arranged side-by-side. In addition to carbon, the rod 16 may be fabricated of other fibrous bundles or materials suitable for providing reinforcement to the lightweight beam 10. In some aspects, the rod 16 may be prefabricated. In other aspects, the rod 16 may be formed just prior to or during the assembly of the lightweight beam 10. Any number of rods 16 may be used in a given lightweight beam 10, including, but not limited to one, two, or three rods. Thus, in an aspect utilizing a triangular prism core 12, a rod 16 may be placed at each apex 22, extending substantially parallel to the centerline 18 of the core 12.

In certain aspects, each of the core 12, the cover 14, and the rod 16 may be formed of lightweight or very lightweight materials so as to minimize the weight of the lightweight beam 10. However, variance in requirements of the lightweight beam 10 may result in variance in size, shape, and materials used for the core 12, the cover 14, and the rod 16.

Figure 2:
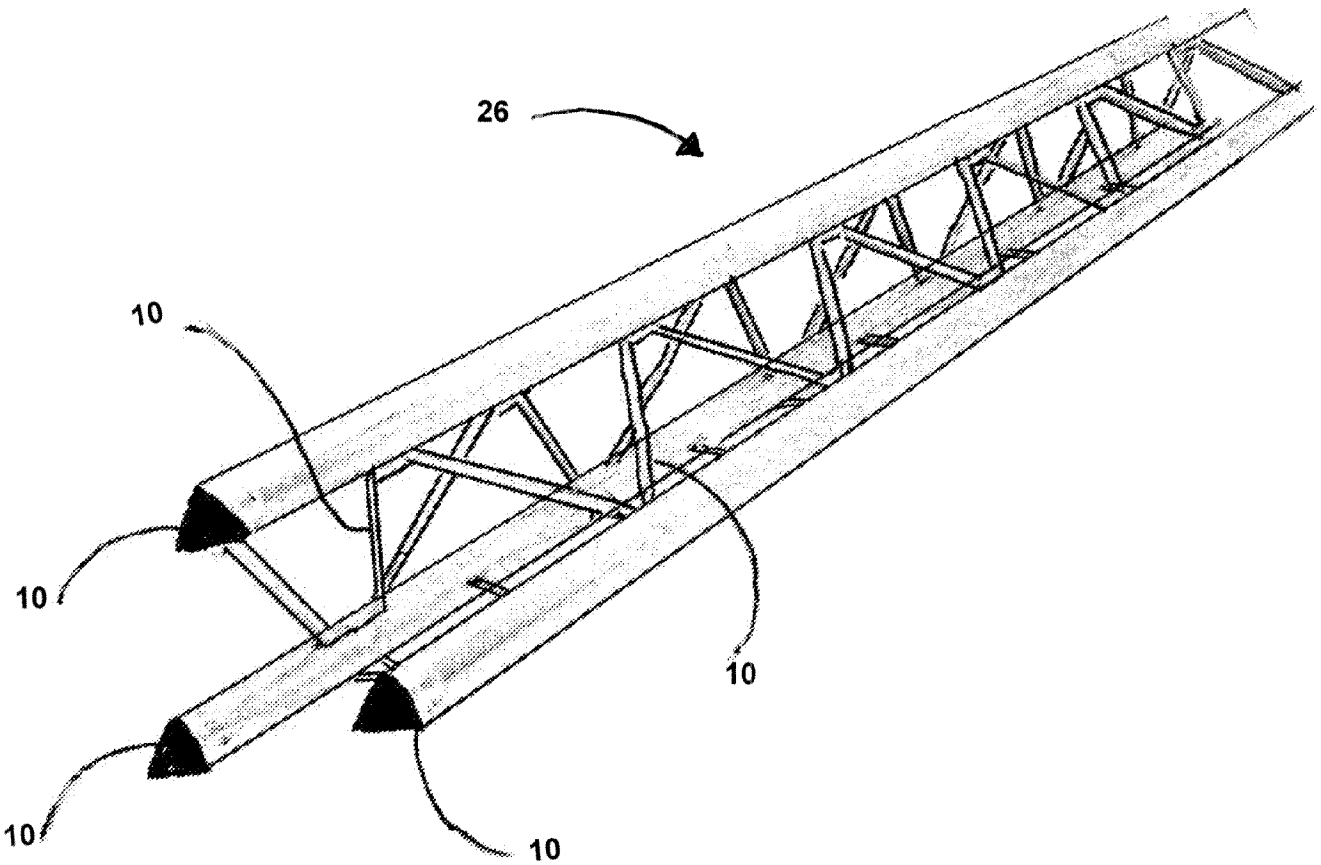
FIG. 2 is a perspective view of a lightweight structure formed from a plurality of lightweight beams, in accordance with one aspect of the present disclosure.

Now referring to FIG. 2, a lightweight structure 26 is shown in accordance with one aspect of the present disclosure. Any number of lightweight beams 10 may be joined to form the lightweight structure 26. Thus, the lightweight beam 10 may act as a prefabricated building block for use in designing the larger structure 26. The structure 26 may form any of a number of load-bearing arrangements, such as trusses, framing, or other components for a building, vessel, or other construct.

Figure 3:
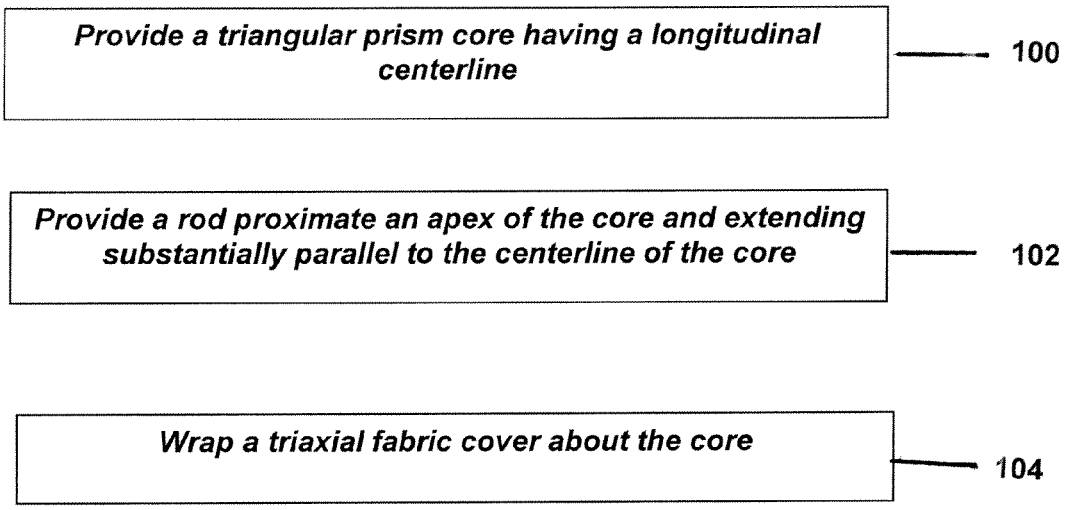
FIG. 3 is a flow chart showing a method of forming a lightweight beam, in accordance with one aspect of the present disclosure.

Now referring to FIG. 3, a flow chart of a method of forming the lightweight beam 10 is illustrated in accordance with one aspect of the present disclosure. Methods of forming the beam 10 may include step 100 of providing the core 12, (e.g., in the form of a triangular prism having the longitudinal centerline 18, and step 102 of providing the rod 16 proximate an apex 22 of the core 12. The rod 16 may be positioned such that the rod 16 extends substantially parallel to the centerline 18 of the core 12. The methods may further include step 104 of wrapping the cover 14 (e.g., in the form of triaxial fabric) about the core 12.

In some aspects, the step 100 of providing the core 12 includes a prior step of fabricating the core 12 from a foam. The step of fabricating may include extruding the foam longitudinally, so as to form the core 12 (e.g., in the form of a triangular prism). In some aspects, the step 102 of providing the rod 16 includes a prior step of fabricating the rod 16 from carbon. In some aspects, the step 102 of providing the rod 16 precedes step 104 of wrapping the cover 14. However, in other aspects, the step 102 of providing the rod 16 is performed after, simultaneously with, or during the step 104 of wrapping the cover 14. In certain aspects, the core 12 may be treated prior to wrapping the cover 14 about the core 12, so as to provide a suitable bonding surface. Similarly, the cover 14 may be treated after it is disposed about the core 12, so as to provide a desired surface for the lightweight beam 10, and ultimately the structure 26. In some aspects, the step 102 of providing the rod 16 may be performed along with steps of providing second and third rods 16 proximate second and third apexes 22, respectively. The second and third rods 16 may each extend substantially parallel to the centerline 18 of the core 12 and may have similar features and construction as the first rod 16.

The foregoing description is provided to enable a person skilled in the art to practice the various configurations described herein. While the subject technology has been particularly described with reference to the various figures and configurations, it should be understood that these are for illustration purposes only and should not be taken as limiting the scope of the subject technology.

There may be many other ways to implement the subject technology. Various functions and elements described herein may be partitioned differently from those shown without departing from the scope of the subject technology. Various modifications to these configurations will be readily apparent to those skilled in the art, and generic principles defined herein may be applied to other configurations. Thus, many changes and modifications may be made to the subject technology, by one having ordinary skill in the art, without departing from the scope of the subject technology.

It is understood that the specific order or hierarchy of steps in the processes disclosed is an illustration of exemplary approaches. Based upon design preferences, it is understood that the specific order or hierarchy of steps in the processes may be rearranged. Some of the steps may be performed simultaneously. The accompanying method claims present elements of the various steps in a sample order, and are not meant to be limited to the specific order or hierarchy presented.

A phrase such as an "aspect" does not imply that such aspect is essential to the subject technology or that such aspect applies to all configurations of the subject technology. A disclosure relating to an aspect may apply to all configurations, or one or more configurations. A phrase such as an aspect may refer to one or more aspects and vice versa.

Furthermore, to the extent that the terms "include," "have," or the like are used in the description or the claims, such terms are intended to be inclusive in a manner similar to the term "comprise" as "comprise" is interpreted when employed as a transitional word in a claim.

The word "exemplary" is used herein to mean "serving as an example, instance, or illustration." Any aspect described herein as "exemplary" is not necessarily to be construed as preferred or advantageous over other aspects.

A reference to an element in the singular is not intended to mean "one and only one" unless specifically stated, but rather "one or more." The term "some" refers to one or more or a portion of the whole, including the whole. All structural and functional equivalents to the elements of the various configurations described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description.

What is claimed is:

1. A beam comprising:

a triangular prism core comprising a first material, the core having a longitudinal centerline, a plurality of apexes, and a length;

at least one rod extending substantially parallel to the centerline of the core and proximate to one of the plurality of apexes; and a cover woven of a yarn comprising a second material different from the first material, the cover disposed about the core and the at least one rod.

2. The beam of claim 1, wherein the second material comprises carbon fibers.

3. The beam of claim 2, wherein the first material comprises a foam.

4. The beam of claim 2, further comprising a bonding enhancement substance disposed between the cover and the core.

5. The beam of claim 1, wherein the cover is woven in an alternating over and under pattern.

6. The beam of claim 1, wherein the at least one rod extends substantially the length of the core.

7. The beam of claim 1, wherein the woven yarn forms a fabric, the cover comprises a plurality of layers of the fabric, and the at least one rod lies between the layers of the fabric.

8. The beam of claim 1, comprising two rods extending substantially parallel to the centerline of the core, and respectively proximate two of the plurality of apexes of the core.

9. The beam of claim 8, comprising three rods extending substantially parallel to the centerline of the core and respectively proximate three of the plurality of apexes of the core.

10. A lightweight beam structure comprising:

a plurality of lightweight beams joined to form a structure;

wherein each of the lightweight beams comprises:

a triangular prism core comprising a first material, the core having a longitudinal centerline and a plurality of apexes;

at least one rod extending substantially parallel to the centerline of the core and proximate to one of the plurality of apexes; and a cover woven of a yarn comprising a second material different from the first material, the cover disposed about the core and the at least one rod.

11. A method of forming a beam, the method comprising the steps of:

providing a triangular prism core comprising a first material and having a longitudinal centerline;

providing at least one rod respectively proximate to at least one of the plurality of apexes of the core and extending substantially parallel to the centerline of the core; and wrapping a cover woven of a yarn comprising a second material different from the first material about the core.

12. The method of claim 11, wherein the step of providing the at least one rod occurs prior to the step of wrapping the cover.

13. The method of claim 11, wherein:

the step of wrapping the cover comprises a step of wrapping a first layer of the cover around the core and a subsequent step of wrapping a second layer of the cover around at least a portion of the first layer of the cover; and the step of providing the at least one rod occurs between the step of wrapping a first layer of the cover and the step of wrapping a second layer of the cover.

14. The method of claim 11, further comprising the step of applying a bonding enhancement substance to the core prior to wrapping the cover.

15. The method of claim 11, further comprising the step of treating the cover after the cover is wrapped about the core.

16. The method of claim 11, wherein the step of providing the core comprises fabricating the core from a foam.

17. The method of claim 16, wherein fabricating the core comprises extruding the foam longitudinally, so as to form the triangular prism.

18. The method of claim 11, wherein the step of providing the rod comprises fabricating the rod from carbon.

19. The method of claim 11, wherein the step of providing the rod comprises providing a second rod proximate a second apex of the plurality of apexes of the core and extending substantially parallel to the centerline of the core.

20. The method of claim 19, wherein the step of providing the rod comprises providing a third rod proximate a third apex of the plurality of apexes of the core and extending substantially parallel to the centerline of the core.

* * * * *